US007052336B2

(12) United States Patent
Tsai

(10) Patent No.: US 7,052,336 B2
(45) Date of Patent: May 30, 2006

(54) TERMINAL STRUCTURE OF A ZIF ELECTRICAL CONNECTOR

(76) Inventor: Chou Hsuan Tsai, 15F.No. 4, Lane 127, Sec. 1 Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/004,015

(22) Filed: Dec. 2, 2004

(65) Prior Publication Data

US 2005/0130512 A1 Jun. 16, 2005

(51) Int. Cl.
*H01R 11/22* (2006.01)

(52) U.S. Cl. ..... 439/857; 439/342

(58) Field of Classification Search ..... 439/857, 439/342, 856, 259–265
See application file for complete search history.

(56) References Cited

U.S. PATENT DOCUMENTS

| | | | | |
|---|---|---|---|---|
| 4,498,725 | A * | 2/1985 | Bright et al. | 439/347 |
| 4,997,385 | A * | 3/1991 | Casagrande | 439/259 |
| 5,092,789 | A * | 3/1992 | Sinclair | 439/259 |
| 6,558,182 | B1 * | 5/2003 | Ohkita et al. | 439/342 |
| 6,638,119 | B1 * | 10/2003 | Chang | 439/857 |

* cited by examiner

*Primary Examiner*—Alexander Gilman
(74) *Attorney, Agent, or Firm*—Pro-Tector Int'l Services

(57) ABSTRACT

A terminal structure of a ZIF (Zero Insertion Force) electrical connector includes a U-shaped main body, two first plates and two second plates. The U-shaped main body has two side plate surfaces facing each other with a gap formed therebetween. The first plates are disposed at a top front section of the U-shaped main body and face each other with a first gap formed therebetween. The second plates are disposed at a top rear section of the U-shaped main body and face each other with a second gap formed therebetween, and the second gap is smaller than the first gap.

9 Claims, 4 Drawing Sheets

TERMINAL STRUCTURE OF A ZIF ELECTRICAL CONNECTOR

BACKGROUND OF THE INVENTION

1. Field of the Invention

The invention relates to an electrical connector, and more particularly to a terminal structure of a ZIF (Zero Insertion Force) electrical connector.

2. Description of the Related Art

A center processing unit (CPU) has many pins to be connected to a ZIF (Zero Insertion Force) electrical connector, which is disclosed in Taiwan Patent Publication Nos. 269919 (U.S. Pat. No. 5,616,044), 240866 and 271866.

FIG. 1 is a pictorially exploded view showing a conventional ZIF electrical connector. Referring to FIG. 1, the ZIF electrical connector has a plastic base 10 and several terminals 15. The plastic base 10 is formed with a plurality of terminal slots 11. The terminal 15 has a fixing portion 16, a pin 17, an elastic arm 18 and a contact sheet 19. The fixing portion 16 may be fixed to the terminal slot 11. The pin 17 is connected to the fixing portion 16 and extends downwards. The elastic arm 18 is connected to the fixing portion 16, and the contact sheet 19 is connected to a top of the elastic arm 18. The contact sheet 19 has a two-step shape such that the contact sheet 19 and the terminal slot 11 form a wide region 12 and a narrow region 13 when the terminal is assembled in the terminal slot 11. Thus, when the CPU is connected to the terminal, the pin of the CPU can be inserted into the wide region 12 with zero force, and then slide into the narrow region 13 to be electrically connected to the contact sheet 19.

Although the conventional terminal structure is very simple and easy to be manufactured by way of pressing, the terminal only contacts the pin at a single surface, and the electrical connection effect is not very good.

FIG. 2 is a pictorial view showing a terminal of the conventional ZIF electrical connector, which is disclosed in Taiwan Patent Publication No. 271866. The ZIF electrical connector of FIG. 2 includes an inverse U-shaped main body 21 and a pin 22 connected to a bottom of the main body. The main body 21 is also formed with an inverse U-shaped open slot 23 such that the main body 21 can be elastically opened toward two sides. The open slot 23 is formed with a narrow slot 24. When the CPU is connected to the terminal, the pin of the CPU may be inserted into the front of the narrow slot 24, and then slide into the narrow slot 24 to be electrically connected to the main body 21.

When the pin of the CPU slides into the narrow slot 24 to be electrically connected to the main body 21, the pin of the CPU is clamped by two surfaces, through which the electrical connection is made. However, the connection portions are in the narrow slot 24, which is an open plate slot, and the contact surface areas of the cut surfaces are small because the plate thickness of the main body 21 is small. Thus, the electrical connection effect is not good, and the cut surfaces are rougher and may thus scratch the gold-plated layer of the pin of the CPU.

SUMMARY OF THE INVENTION

It is therefore an object of the invention to provide a terminal structure of a ZIF electrical connector so as to achieve good electrically connection effects with a simple structure manufactured by simple manufacturing processes.

To achieve the above-mentioned object, the invention provides a terminal structure of a ZIF (Zero Insertion Force) electrical connector. The terminal structure includes a U-shaped main body, two first plates and two second plates. The U-shaped main body has two side plate surfaces facing each other with a gap formed therebetween. The first plates are disposed at a top front section of the U-shaped main body and face each other with a first gap formed therebetween. The second plates are disposed at a top rear section of the U-shaped main body and face each other with a second gap formed therebetween, and the second gap is smaller than the first gap.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
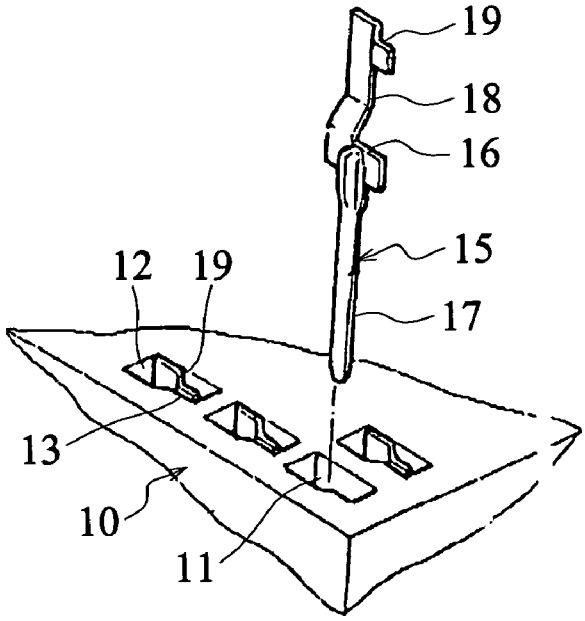
FIG. 1 (Prior Art)
FIG. 1 is a pictorially exploded view showing a conventional ZIF electrical connector.
Figure 2:
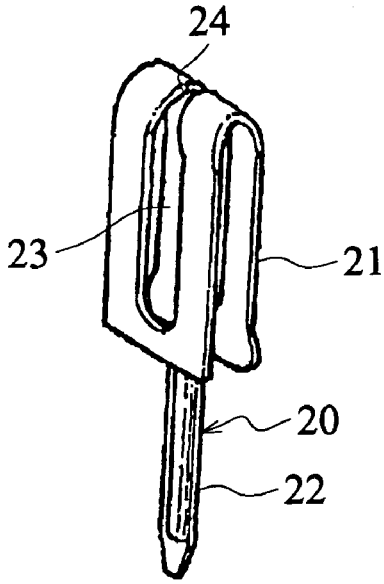
FIG. 2 (Prior Art)
FIG. 2 is a pictorial view showing a terminal of the conventional ZIF electrical connector.
Figure 3:
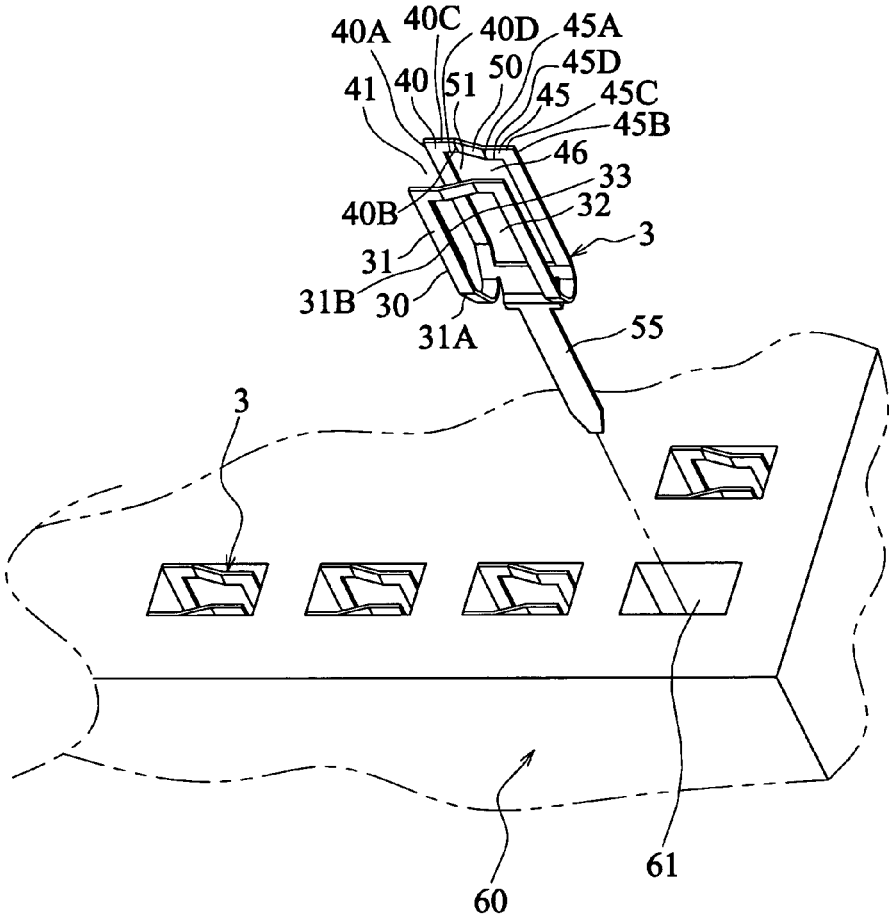
FIG. 3 is a pictorially exploded view showing a ZIF electrical connector according to a first embodiment of the invention.

Referring to FIG. 3, a ZIF (Zero Insertion Force) electrical connector of this embodiment includes a plastic base 60 and a plurality of terminals 3. The plastic base 60 is formed with a plurality of terminal slots 61. The terminal 3 is integrally formed with a U-shaped main body 30, two first plates 40, two second plates 45, two third plates 50 and one pin 55.

The U-shaped main body 30 has two side plate surfaces 31 facing each other with a gap formed therebetween, and adjacent surfaces 33 adjacent to each of the side plate surfaces 31. Each of the side plate surfaces 31 is larger than each of the adjacent surfaces 33 adjacent to the side plate surface 31, and each of the side plate surfaces 31 has a short side 31A and a long side 31B, which is longer than the short side 31A and extends in a vertical direction. Each side plate surface 31 is formed with an opening 32 and thus has a frame shape such that the U-shaped main body 30 has good elasticity.

The two first plates 40 are disposed at a top front section of the U-shaped main body 30, and the two first plates 40 face each other with a first gap 41 formed therebetween-middles of the first plates 40. The two first plates 40 are entirely higher than the U-shaped main body 30 with respect to the vertical direction. Each of the first plates 40 has a front side 40A, a rear side 40B, a top side 40C and a bottom side 40D.

The two second plates 45 are disposed at a top rear section of the U-shaped main body 30, and the two second plates 45 face each other with a second gap 46 formed between middles of the second plates 45, wherein the second gap 46 is smaller than the first gap 41. The two second plates 45 are entirely higher than the U-shaped main body 30 with respect to the vertical direction. Each of the second plates 45 has a front side 45A, a rear side 45B, a top side 45C and a bottom side 45D, The front sides 40A and the bottom sides 40D of the first plates 40 are connected to the U-shaped main body 30. The rear sides 40B of the first plates 40 are closer to the second plates 45 than the front sides 40A of the first plates 40. The front sides 45A of the second plates 45 are closer to the first plates 40 than the rear sides 4513 of the second plates 45. The bottom sides 45D and the rear sides 45B of the second plates 45 are connected to the U-shaped main body 30.

The two third plates 50 are disposed at a top of the U-shaped main body 30 and between the first plates 40 and the second plates 45. The third plates 50 respectively connect the two first plates 40 to the two second plates 45. The two first plates 40 are substantially parallel to each other, and the two second plates 45 are substantially parallel to each other. The third plates 50 face each other with a third gap 51 formed therebetween, wherein the third gap 51 shrinks from the first gap 41 to the second gap 46.

The pin 55, which longitudinally extends downwards, is formed by pressing and jabbing into one of the side plate surfaces 31 of the U-shaped main body, and the side plate surface 31 is formed with the opening.

Figure 4:
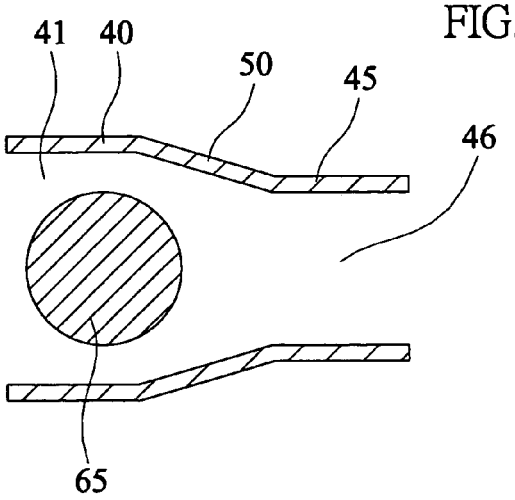
FIG. 4 is a schematic top view showing one usage state according to the first embodiment of the invention.
Figure 5:
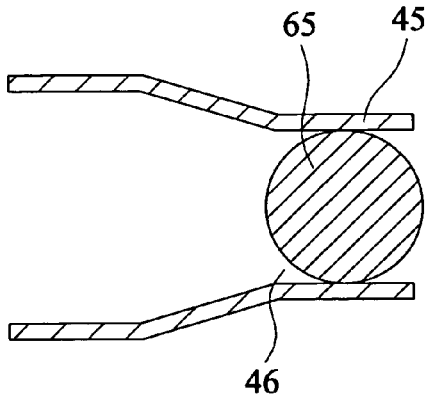
FIG. 5 is a schematic top view showing another usage state according to the first embodiment of the invention.

According to the above-mentioned structure, when the terminal 3 is assembled into the terminal slot 61 of the plastic base 60, the terminal 3 can be tightly fixed according to the elasticity of the main body 30. As shown in FIG. 4, the pin 65 of the CPU is firstly inserted into the first gap 41. Then, as shown in FIG. 5, when the CPU is moved, its pin 65 slides into the second gap 46 and is clamped by the second plates 45 with the plate elasticity.

Figure 6:
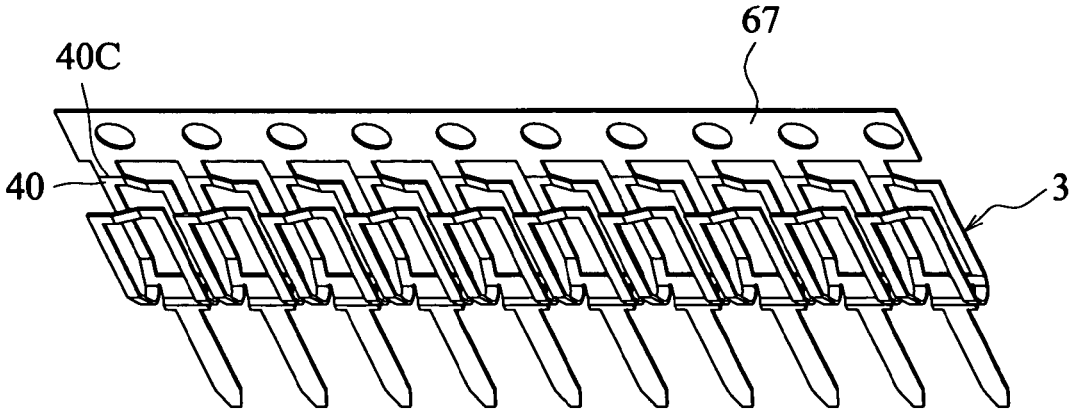
FIG. 6 is a pictorial view showing the terminals and the material tape according to the first embodiment of the invention.

FIG. 6 is a pictorial view showing the terminals 3 and the material tape 67 according to the first embodiment of the invention. The structure of the invention is very simple. Each terminal is formed by bending a U-shaped plate, and the pin is formed by pressing and jabbing into the side plate surface 31 of the U-shaped main body 30. Thus, the terminals 3 may be easily manufactured with reduced material. In addition, the terminals 3 may be arranged on and connected to the material tape 67 according to the gaps between the terminal slots 61, so a row of terminals 3 may be assembled into the terminal slots 61 of the plastic base at the same time. Thus, the material tape 67 is connected to the top side 40C of one of the first plates 40.

The terminal structure of the invention has the following advantages.

1. The structure is simplified and is easily to be manufactured with reduced material.

2. The terminals 3 may be arranged on and connected to the material tape 67 according to the gaps between the terminal slots 61, so a row of terminals 3 may be assembled into the terminal slots 61 of the plastic base at the same time.

3. The pin 65 of the CPU is clamped between the elastic second plates 45, so the electrical connection effect is good. In addition, the plate is smooth and is free from scratching the gold-plated layer of the pin of the CPU.

Figure 7:
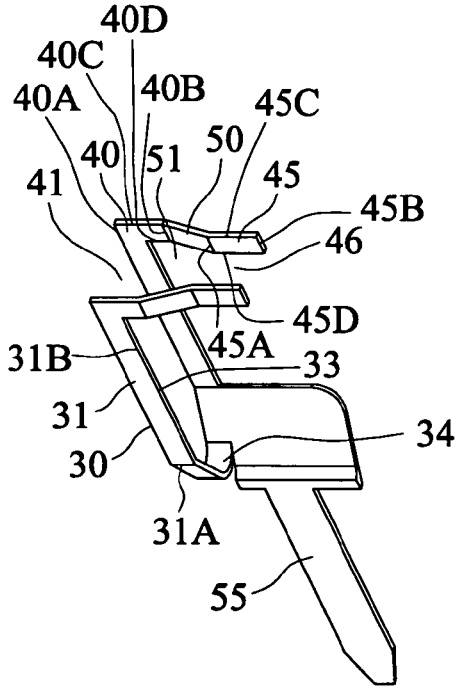
FIG. 7 is a pictorial view showing a ZIF electrical connector according to a second embodiment of the invention.

As shown in FIG. 7, the second embodiment is almost the same as the first embodiment. Similarly, the terminal of the second embodiment also has a U-shaped main body 30, two first plates 40, a first gap 41, two second plates 45, a second gap 46, two third plates 50, a third gap 51 and a pin 55. The difference between the first and second embodiments resides only in that most of the two side plate surfaces 31 of the U-shaped main body 30 of the second embodiment is removed and only a small plate is left. Thus, only the two first plates 40 are connected to a top of the side plate surface 31, and the two second plates 45 are not connected to the side plate surface 31. Consequently, the two second plates 45 may have higher elasticity and may be easily moved in an elastic manner.

In detail, the terminal structure of FIG. 7 includes a U-shaped main body 30, two first plates 40, two second plates 45, two third plates 50 and a pin 55. The U-shaped main body 30 has two side plate surfaces 31 facing each other with a gap formed therebetween, an arced surface 34 connecting the two side plate surfaces 31, and adjacent surfaces 33 adjacent to each of the side plate surfaces 31. Each of the side plate surfaces 31 is larger than each of the adjacent surfaces 33 adjacent to the side plate surface 31. Each of the side plate surfaces 31 has a short side 31A and a long side 31B, which is longer than the short side 31A and extends in a vertical direction. The first plates 40 are disposed at a top front section of the U-shaped main body 30 and substantially parallel to each other. The two first plates 40 are entirely higher than the U-shaped main body 30 with respect to the vertical direction. The two first plates 40 face each other with a first gap 41 formed therebetween. Each of the first plates 40 has a front side 40A, a rear side 40B, a top side 40C and a bottom side 40D. The second plates 45 face each other and are substantially parallel to each other with a second gap 46 formed therebetween. The second gap 46 is smaller than the first gap 41. Each of the second plates 45 has a front side 45A, a rear side 45B, a top side 45C and a bottom side 45D. The third plates 50 respectively connect the front sides 45A of the second plates 45 to the rear sides 40B of the first plates 40. The third plates 50 face each other with a third gap 51 formed therebetween. Two second plates 45 are entirely higher than the U-shaped main body 30 with respect to the vertical direction. The front sides 40A and the bottom sides 40D of the first plates 40 are connected to the U-shaped main body 30. A normal perpendicular to a bottom of the arced surface 34 extends in the vertical direction. The rear sides 40B of the first plates 40 are closer to the second plates 45 than the front sides 40A of the first plates 40. The front sides 45A of the second plates 45 are closer to the first plates 40 than the rear sides 45B of the second plates 45. The pin 55 longitudinally extends downwards and is formed by pressing and jabbing into one of the side plate surfaces 31 of the U-shaped main body 30.

Figure 8:
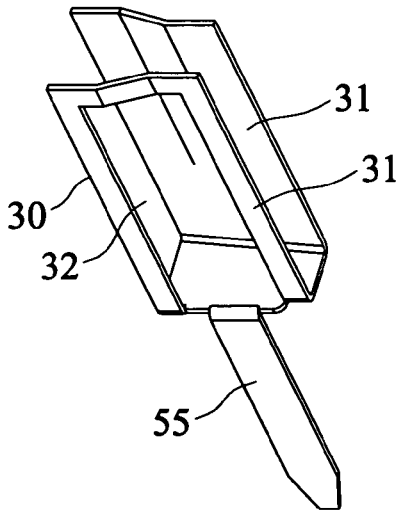
FIG. 8 is a pictorial view showing a ZIF electrical connector according to a third embodiment of the invention.

As shown in FIG. 8, the terminal of the third embodiment is almost the same as that of the first embodiment. The main difference between the third and first embodiments resides only in that only one side plate surface 31 of the U-shaped main body 30 has the opening 32, and a pin 55 longitudinally extending downwards is formed by pressing and jabbing into the side plate surface 31.

Figure 9:
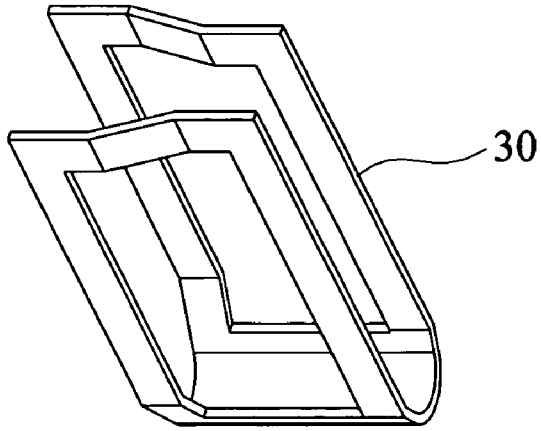
FIG. 9 is a pictorial view showing a ZIF electrical connector according to a fourth embodiment of the invention.
Figure 10:
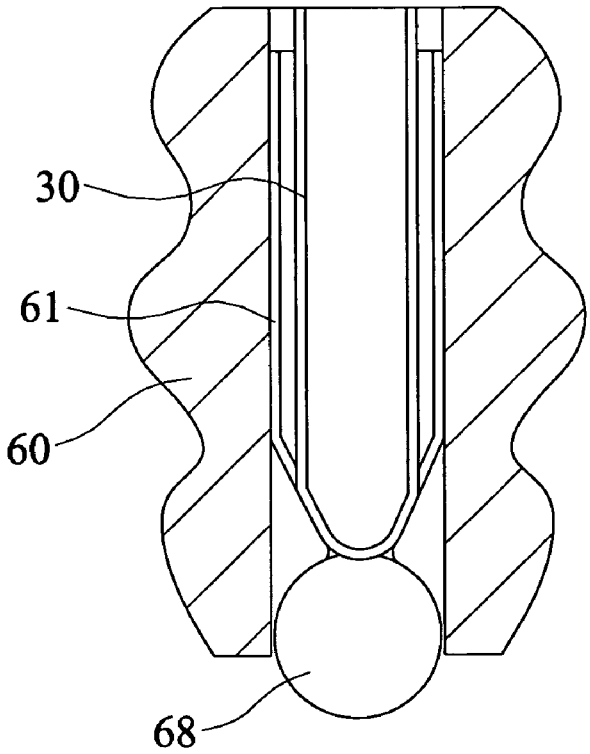
FIG. 10 shows a usage state of the ZIF electrical connector according to the fourth embodiment of the invention.

As shown in FIG. 9, the terminal of the fourth embodiment is almost the same as that of the first embodiment. The main difference between the fourth and first embodiments resides only in that no longitudinally extending pin is connected to the U-shaped main body 30 in the fourth embodiment. As shown in FIG. 10, after the terminal is assembled into the terminal slot 61 of the plastic base 60, a solder ball 68 is mounted to the bottom of the terminal slot 61 and electrically connected to the U-shaped main body 30. Thus, a solder ball type connection point is formed.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A terminal structure of a ZIF (Zero Insertion Force) electrical connector, comprising:

a U-shaped main body having two side plate surfaces facing each other with a gap formed therebetween, and adjacent surfaces adjacent to each of the side plate surfaces, wherein each of the side plate surfaces is larger than each of the adjacent surfaces adjacent to the side plate surface, and each of the side plate surfaces has a short side and a long side, which is longer than the short side and extends in a vertical direction;

two first plates disposed at a top front section of the U-shaped main body, wherein the two first plates are entirely higher than the U-shaped main body with respect to the vertical direction, the two first plates face each other with a first gap formed between middles of the first, and each of the first plates has a front side, a rear side, a top side and a bottom side; and two second plates disposed at a top rear section of the U-shaped main body, wherein the two second plates are entirely higher than the U-shaped main body with respect to the vertical direction, each of the second plates has a front side a rear side, a top side and a bottom side, the bottom sides and the rear sides of the second plates are connected to the U-shaped main body, the two second plates face each other with a second gap formed between middles of the second plates, the second gap is smaller than the first gap, the front sides and the bottom sides of the first plates are connected to the U-shaped main body, the rear sides of the first plates are closer to the second plates than the front sides of the first plates, and the front sides of the second plates are closer to the first plates than the rear sides of the second plates.

2. The terminal structure according to claim 1, wherein each of the two side plate surfaces of the U-shaped main body has an opening.

3. The terminal structure according to claim 1, further comprising a pin, which longitudinally extends downwards and is formed by pressing and jabbing into one of the side plate surfaces of the U-shaped main body, wherein the side plate surface is formed with an opening.

4. The terminal structure according to claim 1, further comprising two third plates disposed on a top of the U-shaped main body and respectively connecting the two first plates to the two second plates, wherein the two third plates face each other with a third gap formed therebetween, the two first plates are substantially parallel to each other, the two second plates are substantially parallel to each other, and the third gap gradually shrinks from the first gap to the second gap.

5. The terminal structure according to claim 1, further comprising a solder ball connected to a bottom of the U-shaped main body, wherein the solder ball serves as a connection point.

6. The terminal structure according to claim 1, further comprising a material tape connected to the top side of one of the first plates.

7. A terminal structure of a ZIF (Zero Insertion Force) electrical connector, comprising:

a U-shaped main body having two side plate surfaces facing each other with a gap formed therebetween, an arced surface connecting the two side plate surfaces, and adjacent surfaces adjacent to each of the side plate surfaces, wherein each of the side plate surfaces is larger than each of the adjacent surfaces adjacent to the side plate surface, and each of the side plate surfaces has a short side and a long side, which is longer than the short side and extends in a vertical direction;

two first plates disposed at a top front section of the U-shaped main body and substantially parallel to each other, wherein the two first plates are entirely higher than the U-shaped main body with respect to the vertical direction, the two first plates face each other with a first gap formed therebetween, and each of the first plates has a front side, a rear side, a top side and a bottom side;

two second plates facing each other and substantially parallel to each other with a second gap formed therebetween, the second gap being smaller than the first gap, each of the second plates having a front side, a rear side, a top side and a bottom side; and two third plates respectively connecting the front sides of the second plates to the rear sides of the first plates, the third plates facing each other with a third gap formed therebetween, wherein the two second plates are entirely higher than the U-shaped main body with respect to the vertical direction, the front sides and the bottom sides of the first plates are connected to the U-shaped main body, a normal perpendicular to a bottom of the arced surface extends in the vertical direction, the rear sides of the first plates are closer to the second plates than the front sides of the first plates, and the front sides of the second plates are closer to the first plates than the rear sides of the second plates.

8. The terminal structure according to claim 7, further comprising a pin, which longitudinally extends downwards and is formed by pressing and jabbing into one of the side plate surfaces of the U-shaped main body.

9. The terminal structure according to claim 8, further comprising a solder ball connected to a bottom of the U-shaped main body, wherein the solder ball serves as a connection point.

* * * * *